US009385452B2

(12) United States Patent
Fu et al.

(10) Patent No.: US 9,385,452 B2
(45) **Date of Patent: *Jul. 5, 2016**

(54) CARD EDGE CONNECTOR WITH AN IMPROVED EJECTOR

(71) Applicant: FOXCONN INTERCONNECT TECHNOLOGY LIMITED, Grand Cayman (KY)

(72) Inventors: Xiao-Zhi Fu, Kunshan (CN); Ze-Lin Yao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 14/795,084

(22) Filed: Jul. 9, 2015

(65) Prior Publication Data

US 2016/0013589 A1 Jan. 14, 2016

(30) Foreign Application Priority Data

Jul. 9, 2014 (CN) ..... 2014 2 0377000 U

(51) Int. Cl.
*H01R 13/62* (2006.01)
*H01R 12/70* (2011.01)

(52) U.S. Cl.
CPC ..... *H01R 12/7005* (2013.01)

(58) Field of Classification Search
CPC ..... H01R 13/635; H01R 33/05
USPC ..... 439/159, 156, 630, 631
See application file for complete search history.

(56) References Cited

U.S. PATENT DOCUMENTS 5,660,552 A * 8/1997 Suzuki ..... H01R 12/7005 439/157
7,866,995 B1 * 1/2011 Kudo ..... H01R 12/721 439/157
7,955,099 B2 * 6/2011 Tan ..... H01R 12/721 439/157
8,602,677 B2 * 12/2013 Peng ..... G06F 1/185 361/801

FOREIGN PATENT DOCUMENTS

TW M429217 5/2012

* cited by examiner

*Primary Examiner* — Phuongchi T Nguyen
(74) *Attorney, Agent, or Firm* — Wei Te Chung; Ming Chieh Chang

(57) ABSTRACT

A card edge connector includes an elongated insulative housing extending along a left-to-right direction, a plurality of conductive terminals retained in the insulative housing and an ejector retained at one end of the insulative housing. The insulative housing defines a central slot recessed from an upper surface thereof for receiving a memory module. The ejector defines a base portion and a pair of gripping portions extending upwardly from the base portion, two gripping portions have an accommodating slot located therebetween for receiving the memory module and a lump portion located in the accommodating slot. The lump portion defines an elastic arm projecting into the accommodating slot for locking the memory module, When the memory module is pulled out in a hard-interference manner, the memory module will press upwardly against the elastic arm so that the elastic arm is elastically deformed to release the memory module.

20 Claims, 5 Drawing Sheets

CARD EDGE CONNECTOR WITH AN IMPROVED EJECTOR

BACKGROUND OF THE INVENTION

1. Field of the Invention

The present invention relates to a card edge connector, and more particularly to a card edge connector with an improved ejector assembled therein.

2. Description of the Related Art

Card edge connector is usually assembled on a mother board and then engages with a daughter board for interconnecting between the two boards. Taiwan Pat. No. M429217 issued on May 11, 2012 with a counterpart U.S. Pat. No. 8,858,257, discloses a card edge connector including an elongated insulative housing extending along a left-to-right direction, a plurality of conductive terminals retained in the insulative housing and an ejector assembled to a side of the insulative housing. The insulative housing defines a central slot recessed from the upper surface thereof and used for receiving a memory module. The ejector defines a base portion and two gripping portions extending upwardly from two sides of the base portion, two gripping portions have a accommodating slot located therebetween for receiving the memory module and a lump portion located in the accommodating slot and used for locking the memory module. However, when customers did not notice the ejector and brute force to pull the memory module, it is easy to make the ejector fallen off the card edge connector and make the lump portion of the ejector damaged.

Therefore, an improved card edge connector is highly desired to meet overcome the requirement.

BRIEF SUMMARY OF THE INVENTION

An object of the present invention is to provide a card edge connector with an improved ejector assembled therein to stably grip a memory module.

In order to achieve above-mentioned object, a card edge connector includes an elongated insulative housing extending along a left-to-right direction, a plurality of conductive terminals retained in the insulative housing and an ejector retained at one end of the insulative housing. The insulative housing defines a central slot recessed from an upper surface thereof for receiving a memory module. The ejector defines a base portion and a pair of gripping portions extending upwardly from the base portion, two gripping portions have an accommodating slot located therebetween for receiving the memory module and a lump portion located in the accommodating slot. The lump portion defines an elastic arm projecting into the accommodating slot for locking the memory module, When the memory module is pulled out in a hard-interference manner, the memory module will press upwardly against the elastic arm so that the elastic arm is elastically deformed to release the memory module.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
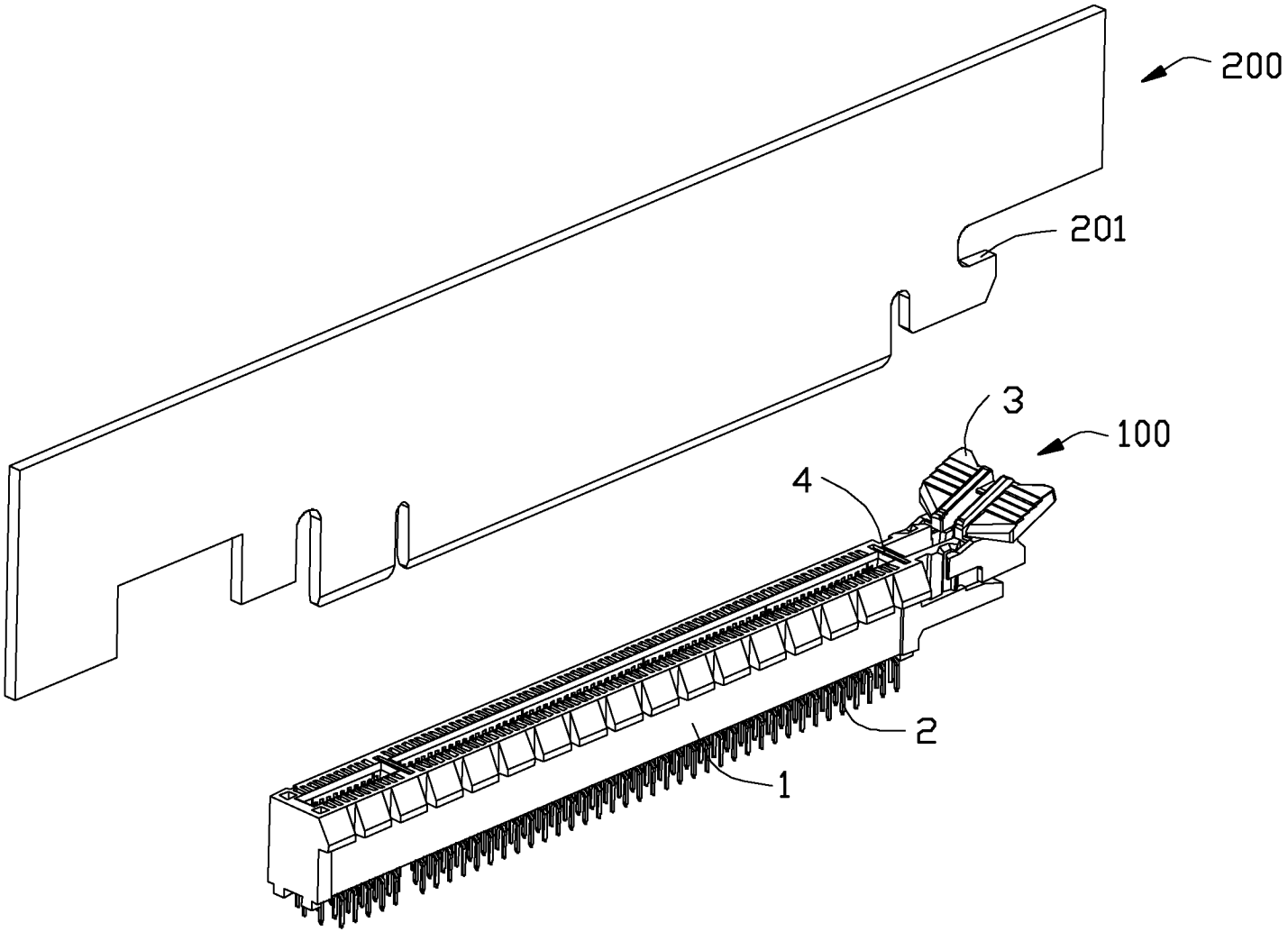
FIG. 1 is a perspective view showing a card edge connector with a memory module in accordance with the present invention.
Figure 2:
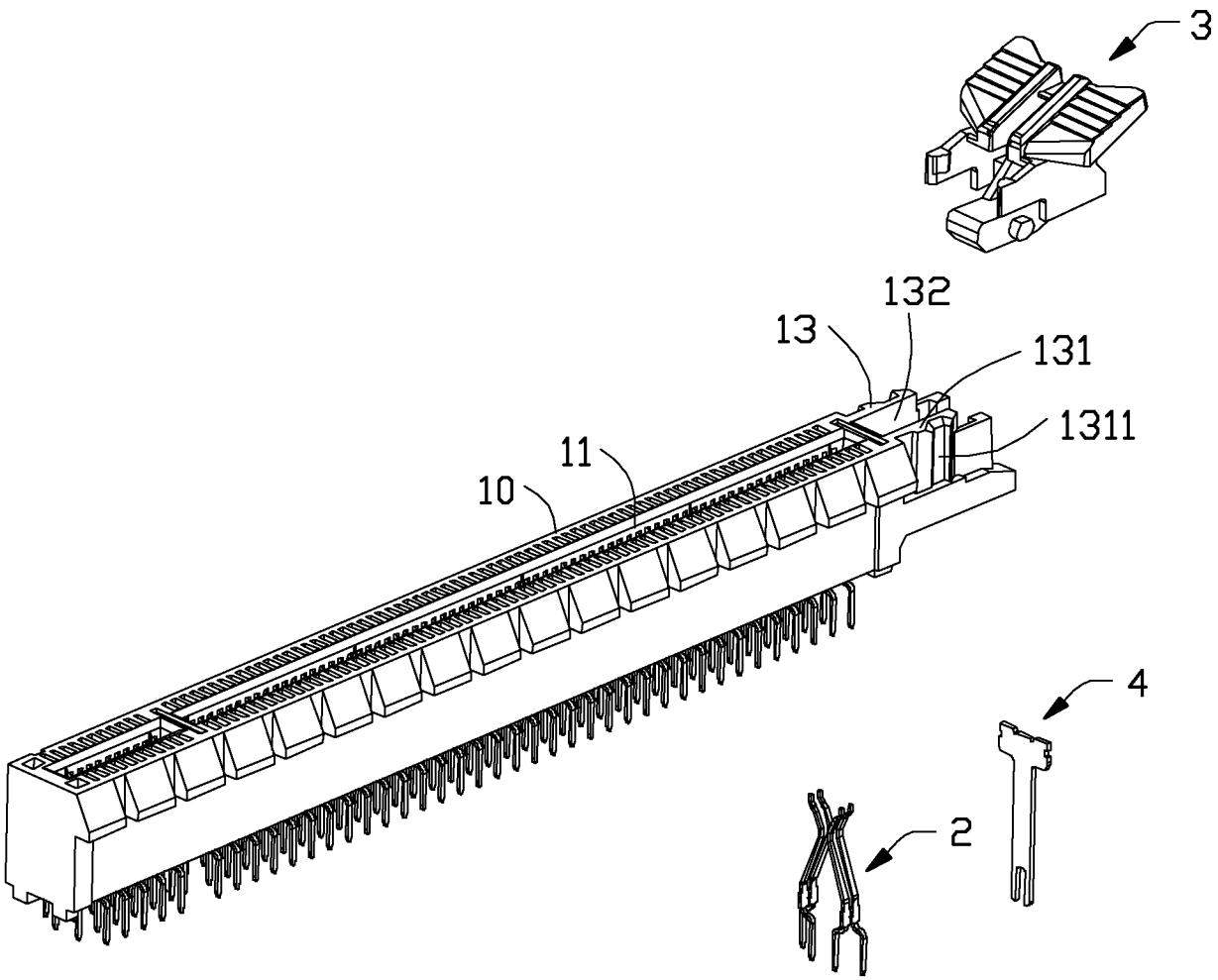
FIG. 2 is an exploded perspective view of the card edge connector shown in FIG. 1.

Reference will now be made to the drawing figures to describe a preferred embodiment of the present invention in detail. Referring to FIG. 1 to FIG. 2, a card edge connector 100 is preferably a memory socket to be mounted on a mother printed circuit board and includes an elongated insulative housing 1 extending along a left-to-right or longitudinal direction, a plurality of conductive terminals 2 retained in the insulative housing 1, an ejector 3 pivoted on one end of the insulative housing 1 and latching a notch of a memory module 200 and a pair of board locks 4 mounted onto a bottom of the insulative housing 1.

Figure 3:
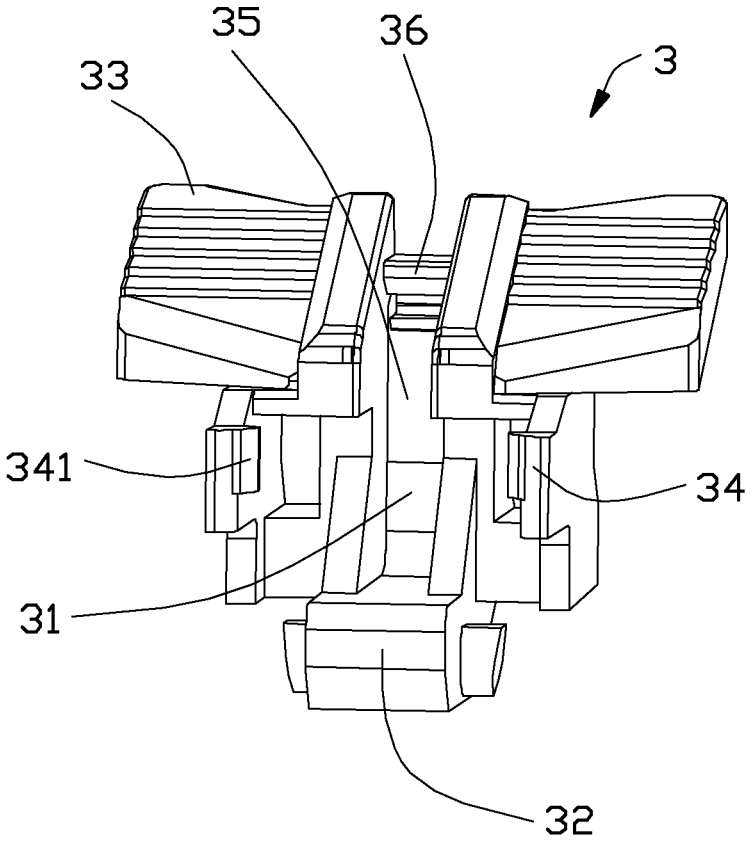
FIG. 3 is a perspective view of the ejector of the card edge connector shown in FIG. 1.

Referring to FIG. 3, the insulative housing 1 defines a central slot 11 recessed from the upper surface 10 thereof and used for receiving the memory module 200 and an attaching portion 13 extending outside from one end of the insulative housing 1. The attaching portion 13 defines a pair of opposite side walls 131 and an attaching space 132 formed between the side walls 131.

The ejector 3 is retained in the attaching portion 13 and includes a base portion 31, an ejecting portion 32 extending inwardly to the attaching space 132 from a lower end of the base portion 31, a pair of gripping portions 33 extending upwardly and aslant from the base portion 31 and a pair of extending portions or locking arms 34 extending toward the attaching portion 13 from both sides of the base portion 31. The ejecting portion 32 is used to eject the memory module 200 and has a pair of pivotal shafts located at two outer lateral sides thereof and received into the attaching space 132. Each extending portions 34 defines a protruding portion 341 located in a front thereof and extending inwardly thereof, and the attaching portion 13 defines a pair of retaining slots 1311 located in two side walls 131 thereof and latched with the corresponding protruding portions 341 to prevent the ejector 3 from rotating up and down.

Figure 4:
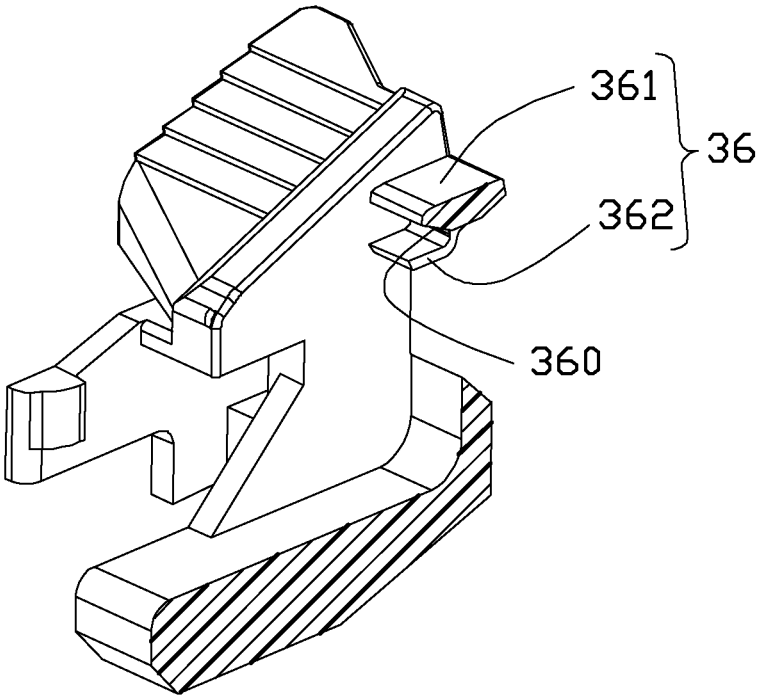
FIG. 4 is a cross-sectional view of the ejector shown in FIG. 3.

Referring to FIG. 4, two gripping portions 33 of the ejector 3 have a accommodating slot 35 located therebetween and running through the ejector 3 in the left-to-right direction for receiving the memory module 200 and a lump portion 36 located in the accommodating slot 35 and used for locking a locking surface 201 in a notch structure of the memory module 200. The accommodating slot 35 further includes a first accommodating slot located above the lump portion 36 and running through the top surface of the ejector 3 and a second accommodating slot located below the lump portion 36 for receiving the bottom edge of the memory module 200. The lump portion 36 defines a connecting portion 361 integrally connecting with two gripping portions 33 and an elastic arm 362 projecting into the accommodating slot 35 from the connecting portion 361 for locking the memory module 200. The connecting portion 361, which may be made by metal and discrete from the gripping portions 33, can also be connected to the gripping portions 33 by other means. In present embodiment, the elastic arm 362 extends integrally from the connecting portion 361 and unconnected laterally with two gripping portions 33 in order to form gaps, which makes the elastic arm 362 can be elastically deformed in the accommodating slot 35, especially in an upward direction.

The connecting portion 361 defines a lower surface, and an oblique surface 360 connecting the lower surface and locating at an inner side of the lower surface for the memory module 200 being pulled out easily, and the elastic arm 362 extends downwardly and horizontally toward the central slot 11 from the lower surface of the connecting portion 361. The locking surface 201 of the memory module 200 is substantially parallel to the elastic arm 362 so that the elastic arm 362 can abut against the locking surface 201 in a surface contact manner, which ensures the elastic arm 362 can better retain the memory module 200 in a normal condition. The angle formed between the oblique surface 360 and the elastic arm 362 is less than 90 degrees in order to restrict the elastically deformation angle of the elastic arm 362. Because the maximum deformation angle of the elastic arm 362 is the angle formed between the oblique surface 360 and the elastic arm 362, the elastic arm 362 abuts against the oblique surface 360 when the elastic arm 362 reaches the maximum deformation.

Figure 5:
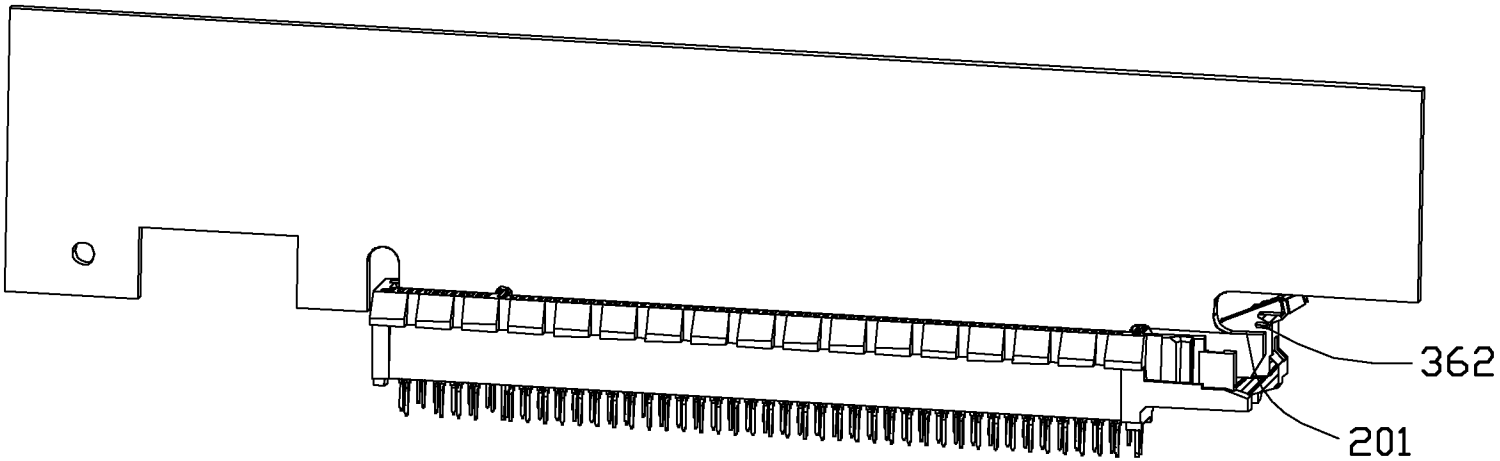
FIG. 5 is a partial cross-sectional view of the card edge connector mating with the memory module shown in FIG. 1.

Referring to FIG. 5, the elastic arm 362 and the locking surface 201 of the memory module 200 defines a gap therebetween, the elastic arm 362 can be smoothly across the locking surface 201 of the memory module 200 via the gap when the ejector 3 is locking the memory module 200, and the size of the gap just ensures the elastic arm 362 is smoothly across the locking surface 201 of the memory module 200. Obviously, the elastic arm 362 is able to define a guiding portion (no shown) in the free end thereof instead of the gap between the elastic arm 362 and the locking surface 201, thus, the elastic arm 362 can be also smoothly across the locking surface 201 of the memory module 200. When the ejector 3 is locking the memory module 200, the elastic arm 362 can press downwardly against the memory module 200 to prevent the memory module 200 loosening. When the memory module 200 is pulled out in a hard-interference manner, especially the user did not notice the ejector 3 and brute force to pull the memory module 200, the memory module 200 will press upwardly against the elastic arm 362 so that the elastic arm 362 is elastically deformed to release memory module 200. Thus it can effectively prevent user from damaging the ejector 3 when user brutally forces to pull the memory module 200. It is noted that in the instant application, the pivotal shafts are formed around the distal end of the ejecting portion 32 and are essentially spaced from the lump portion 36 in the left-to-right direction with a distance in a top view. Under this situation, when the elastic arm is upwardly deformed to extend from the horizontal direction to an oblique direction, the outermost corner of the locking surface 201 may move along such an obliquely deformed/extending elastic arm to push the ejector 30 outwardly rotate about the pivotal shafts so as to release the module from the connector 100. From another technical viewpoint, the elastic arm 362 is essentially cantilevered with an outer root section linked to the connecting portion 361 and a free distal end section which can be upwardly displaced by the locking surface 201 when the module 200 is forcibly upwardly moved so as to compliantly urge the ejector 3 to outwardly rotate from the vertical locking position to the outward/oblique unlocking position, thus assuring no permanent damage to the ejector 3 or the housing 1. In opposite, in the traditional connector as disclosed in the aforementioned U.S. Pat. No. 8,858,257, the forcible upward movement of the module 200 will confront the un-deformable downward horizontal stop face of the lump portion in a harsh manner, and highly possibly crash the related structures around the ejector disadvantageously. Notably, in this embodiment top regions of the gripping portions 33 provides a finger operation/pressing area for manually actuating the ejector 3 in a normal ejection use condition.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, comprising:

an elongated insulative housing extending along a left-to-right direction and defining a central slot recessed from an upper surface thereof for receiving a memory module;

a plurality of conductive terminals retained in the insulative housing; and an ejector retained at one end of the insulative housing and defining a base portion and a pair of gripping portions extending upwardly from the base portion and defining an accommodating slot located therebetween and running through the ejector in the left-to-right direction for receiving the memory module and a lump portion located in the accommodating slot for locking within a notch of the memory module; wherein the lump portion defines an elastic arm projecting into the accommodating slot for locking the memory module, and when the memory module is pulled out in a hard-interference manner, the memory module will press upwardly against the elastic arm so that the elastic arm is elastically deformed to activate outward rotation of the ejector to release the memory module.

2. The card edge connector as described in claim 1, wherein the accommodating slot further includes a first accommodating slot located above the lump portion and running through a top surface of the ejector and a second accommodating slot located below the lump portion for receiving a bottom edge of the memory module.

3. The card edge connector as described in claim 1, wherein the insulative housing defines an attaching portion extending outside from an end wall of the insulative housing, the attaching portion defines a pair of opposite side walls and an attaching space formed between the side walls, the ejector defines an ejecting portion extending inwardly to the attaching space from a lower end of the base portion for ejecting the memory module.

4. The card edge connector as described in claim 3, wherein the ejector defines a pair of extending portions extending toward the attaching portion from both sides of the base portion, each extending portions defines a protruding portion located at the front thereof and extending inwardly thereof and the attaching portion defines a pair of retaining slots located at two side walls thereof and latched with the corresponding protruding portions.

5. The card edge connector as described in claim 1, wherein the lump portion defines a connecting portion integrally connecting with two gripping portions, and the elastic arm is extending integrally from the connecting portion and transversely unconnected with the two gripping portions in order to be elastic.

6. The card edge connector as described in claim 5, wherein the connecting portion defines a lower surface, and an oblique surface connecting the lower surface and locating at an inner side of the lower surface for the memory module being pulled out easily, and the elastic arm extends downwardly and horizontally toward the central slot from the lower surface of the connecting portion.

7. The card edge connector as described in claim 6, wherein the elastic arm latches into a cutout of the memory module and abuts against a locking surface of the memory module in a surface contact manner.

8. The card edge connector as described in claim 6, wherein the angle formed between the oblique surface and the elastic arm is less than 90 degrees.

9. An ejector adapted for being equipped with a card edge connector to lock a memory module inserted into the card edge connector, comprising:

a base portion; and a pair of gripping portions extending upwardly from the base portion an accommodating slot located between said two gripping portions and separating said two gripping portions from each other for receiving the memory module and a pair of lump portions integrally protruding from said corresponding gripping portions and into said accommodating slot for locking the memory module; wherein the lump portions are isolated from one another by an opening so that the lump portions could be resiliently splayed away from each other under a condition that the memory module is removed out from the card edge connector directly in a hard-interference manner;

an ejector pivotally mounted to one end of the housing in said longitudinal direction, said ejector including a base portion, an ejecting portion located below the base portion and extending into the central slot for ejecting the module, and a latch device located above the ejecting portion and aligned with the central slot along the longitudinal direction for locking in a notch of the memory module when said memory module is received within the central slot.

10. The ejector as described in claim 9, wherein the lump portion defines a connecting portion integrally connecting with two gripping portions, and the elastic arm is extending integrally from the connecting portion and unconnected with the two gripping portions in order to be elastic.

11. The ejector as described in claim 10, wherein the defines a lower surface, and an oblique surface connecting the lower surface and locating at an inner side of the lower surface for the memory module being pulled out easily, and the elastic arm extends downwardly and horizontally toward the central slot from the lower surface of the connecting portion.

12. The ejector as described in claim 11, wherein the angle formed between the oblique surface and the elastic arm is less than 90 degrees.

13. An electrical connector for use with a memory module, comprising:

an insulative housing having a central slot extending along a longitudinal direction and upwardly open to an exterior in a vertical direction perpendicular to said longitudinal direction for receiving said memory module therein;

a plurality of contacts disposed in the housing beside said central slot in a transverse direction perpendicular to both said longitudinal direction and said vertical direction; and an ejector pivotally mounted to one end of the housing in said longitudinal direction, said ejector including a base portion, an ejecting portion located below the base portion and extending into the central slot for ejecting the module, and a lump portion having an elastic arm located above the ejecting portion for downwardly confronting a locking surface in a notch of the memory module when said memory module is received within the central slot; wherein the elastic arm is upwardly deformable for complying with a harsh forcible upward movement of the memory module to activate an outward rotation of the ejector for releasing the memory module from the connector.

14. The electrical connector as claimed in claim 13, wherein said elastic arm extends in a cantilevered manner with an outer root section and an inner free end along the longitudinal direction.

15. The electrical connector as claimed in claim 13, wherein said lump portion is unitarily formed with the ejector.

16. The electrical connector as claimed in claim 13, wherein a pivotal shaft of the ejector is located at a same level with the ejecting portion, and the elastic arm is located at an outer side of the pivotal shaft with a distance along said longitudinal direction in a top view.

17. The electrical connector as claimed in claim 13, wherein said ejector includes a pair of gripping portions communing defining an accommodating slot therebetween for receiving the memory module therein, and the lump portion is located in said accommodating slot.

18. The electrical connector as claimed in claim 17, wherein each of said pair of gripping portions provides an upward outwardly extending wing like region for finger operation, and said wing like region is essentially located beside the memory module in the transverse direction when the memory module is received within the central slot.

19. The electrical connector as claimed in claim 17, wherein said ejector further includes a pair of locking arms on two sides in the transverse direction and above the ejecting portion.

20. The electrical connector as claimed in claim 19, wherein said pair of locking arms are located outside of the gripping portions respectively in said transverse direction.

* * * * *